US011097296B2

(12) United States Patent
Knight

(10) Patent No.: US 11,097,296 B2
(45) Date of Patent: Aug. 24, 2021

(54) PUMP DISPENSER WITH OUTLET VALVE

(71) Applicant: Rieke Packaging Systems Limited, Leicester (GB)

(72) Inventor: Simon Christopher Knight, Wales (GB)

(73) Assignee: Rieke Packaging Systems Limited

( * ) Notice: Subject to any disclaimer, the term of this patent is extended or adjusted under 35 U.S.C. 154(b) by 0 days.

(21) Appl. No.: 16/433,061

(22) Filed: Jun. 6, 2019

(65) Prior Publication Data

US 2019/0283055 A1 Sep. 19, 2019

Related U.S. Application Data

(63) Continuation of application No. 15/480,686, filed on Apr. 6, 2017, now Pat. No. 10,350,620, which is a continuation of application No. PCT/GB2015/053113, filed on Oct. 20, 2015.

(60) Provisional application No. 62/066,051, filed on Oct. 20, 2014.

(51) Int. Cl.
*B05B 11/00* (2006.01)
*B65D 47/20* (2006.01)

(52) U.S. Cl.
CPC ..... *B05B 11/0072* (2013.01); *B05B 11/007* (2013.01); *B05B 11/0064* (2013.01); *B05B 11/3001* (2013.01); *B65D 47/2081* (2013.01)

(58) Field of Classification Search
CPC ..... B05B 11/0072; B05B 11/3001; B05B 11/0064; B05B 11/007; B65D 47/2081; B65D 83/345
See application file for complete search history.

(56) References Cited

U.S. PATENT DOCUMENTS

| | | | | |
|---|---|---|---|---|
| 1,765,956 | A | 6/1930 | Wertz | |
| 3,507,586 | A | 4/1970 | Gronemeyer et al. | |
| 4,230,277 | A * | 10/1980 | Tada | B05B 11/0032 239/333 |
| 4,314,658 | A | 2/1982 | Laauwe | |
| 4,349,134 | A * | 9/1982 | Schuster | B65D 47/2081 222/212 |
| 4,887,742 | A | 12/1989 | Roethel et al. | |
| 4,927,061 | A | 5/1990 | Leigh et al. | |
| 5,197,638 | A | 3/1993 | Wood | |
| 5,692,651 | A | 12/1997 | Fuchs | |
| 5,810,203 | A | 9/1998 | Brennan | |
| 5,857,595 | A | 1/1999 | Nilson | |
| 5,950,878 | A | 9/1999 | Wade et al. | |
| 6,053,370 | A | 4/2000 | Ludbrook et al. | |
| 6,343,724 | B1 | 2/2002 | Ophardt et al. | |

(Continued)

FOREIGN PATENT DOCUMENTS

| | | |
|---|---|---|
| DE | 2042690 | 3/1972 |
| DE | 19510007 | 10/1995 |

(Continued)

*Primary Examiner* — Vishal Pancholi
*Assistant Examiner* — Bob Zadeh
(74) *Attorney, Agent, or Firm* — McDonald Hopkins LLC

(57) ABSTRACT

An outlet valve for a dispensing nozzle comprising a first valve component constructed and arranged to be received by the dispensing nozzle and a second valve component constructed and arranged to cooperate with the first valve component. The first valve component and the second valve component define a normally-closed flow interface.

16 Claims, 7 Drawing Sheets

(56) References Cited

U.S. PATENT DOCUMENTS

| | | | | |
|---|---|---|---|---|
| 6,412,665 | B1 | 7/2002 | Taghvi-Khanghah | |
| 7,641,077 | B2 | 1/2010 | Law et al. | |
| 10,350,620 | B2 * | 7/2019 | Knight | B05B 11/007 |
| 2002/0179650 | A1 * | 12/2002 | Mascitelli | B65D 47/2081 222/494 |
| 2004/0112920 | A1 | 6/2004 | Felten | |
| 2005/0087571 | A1 | 4/2005 | Dark | |
| 2009/0188946 | A1 * | 7/2009 | Chien | B05B 11/0032 222/321.3 |
| 2010/0032454 | A1 * | 2/2010 | Moribata | A45D 40/0075 222/494 |
| 2013/0098943 | A1 * | 4/2013 | Sciole | B05B 1/3402 222/321.3 |
| 2017/0209881 | A1 | 7/2017 | Knight | |
| 2019/0283055 | A1 * | 9/2019 | Knight | B65D 47/2081 |

FOREIGN PATENT DOCUMENTS

| | | |
|---|---|---|
| DE | 19622124 | 12/1997 |
| EP | 0538162 | 4/1993 |
| FR | 2785878 | 5/2000 |
| JP | H07-223662 | 8/1995 |
| JP | 2001240088 | 9/2001 |
| JP | 2002002755 | 1/2002 |
| WO | 199705040 | 2/1997 |
| WO | 200007901 | 2/2000 |
| WO | 2004106219 | 12/2004 |

* cited by examiner

PUMP DISPENSER WITH OUTLET VALVE

CROSS REFERENCE TO RELATED APPLICATIONS

This application is a continuation U.S. patent application Ser. No. 15/480,686 filed on Apr. 6, 2017, which was a continuation of PCT/GB2015/053113 filed Oct. 20, 2015, which claimed the benefit of U.S. Provisional Application No. 62/066,051 filed Oct. 20, 2014. All such prior applications are hereby incorporated by reference.

BACKGROUND

In the product dispensing art, various outlet constructions may be utilized as part of the dispensing mechanism or as part of the container. When a dispensing mechanism is used, such as a piston pump, the outlet may be as simple as a nozzle with an outlet opening at one end. Depending on the type of product being dispensed, the viscosity of the product and any related characteristics or properties, there may be value to the end user of the dispenser in having other design concepts integrated into the construction of the outlet, whether that outlet is part of the nozzle or is an outlet of some other form or construction.

As one example, when a product is being dispensed which has a foam consistency, it might be seen as a benefit if any residual foam which is left in or around the outlet can be sucked back into the pump or into some other portion of the dispenser where it will not be an issue. First, sucking back the residual foam reduces the risk of it dripping onto a surface, such as a countertop. Secondly, sucking back the residual foam may prevent that portion of foam from drying out in the outlet and ultimately causing a clog if use of the dispensing pump is infrequent.

Another means of dispensing a product, though not by the use of an actual dispensing mechanism, such as a piston pump, is the use of a flexible, squeeze container. As one example of this type of dispensing mechanism, consider a plastic condiment dispenser and its corresponding product which may be a product such as mustard or catsup. This product is able to be dispensed by squeezing the flexible sides of the plastic container. The "dispenser" includes the container which holds the product and some type of closure, cap, cover or lid or similar closure subassembly with whatever outlet features, such as valving, may be included.

For this disclosure, the phrase "pump mechanism" is used to generally denote a dispensing pump mechanism of some type, such as a piston pump which operates based on the down stroke of an actuator. In the exemplary embodiment, the actuator includes a projecting nozzle with a snap-in outlet member at the distal end of the projecting nozzle. The projecting nozzle defines a fluid passage for the product being dispensed so that at least a majority of that product is able to travel from the outlet of the pump mechanism to and ultimately through the snap-in outlet member. An alternative construction to what is presented as the exemplary embodiment includes the outlet member as an integral portion of the projecting nozzle, while the cooperating valve component which is disclosed herein retains its snap-in characteristic.

This general type of product dispenser which includes a pump mechanism and a projecting nozzle is already known in the art. Also known are various enhancements depending on the nature, amount and composition of the product to be dispensed. One concern with this general type of product dispenser pertains to the flow of product from the outlet of the nozzle. More specifically, there have been concerns of a small portion of the product being left behind in and/or around the nozzle outlet and either dripping onto a surface, such as a countertop, or drying out and either clogging the outlet opening of the nozzle or reducing the flow area of the outlet opening. The latter event can result in increased flow velocity for the product dose during the next dispensing cycle. This increased flow velocity can cause the dose of product to land in an unintended location.

Different construction techniques have been employed to try and control the flow of product and to minimize the issues of residual product being left in or around the nozzle and/or in or around the outlet member, if one is used in conjunction with the nozzle. One construction sets the projecting nozzle at an upward incline to try and cause any residual product to flow back to or through the pump mechanism. Another construction concept uses a weir as a part of the outlet member to address certain characteristics of the fluid flow dynamics. Yet another construction focuses on adding some type of suck-back mechanism which is separate from the pump mechanism.

Each of the construction concepts briefly outlined above may provide certain benefits to the end user depending on the style of pump mechanism, the type of product, the amount of product to be dispensed in each dose, the intended end use, etc. There are though other considerations which might offer opportunities for design improvements. As one example, the referenced suck-back mechanism may be too complex and too inaccessible to permit cleaning of its surfaces. If any residual product clogs or interferes with the functioning of the suck-back mechanism, a complete replacement may be required. While this is not likely an issue when discussing a disposable dispenser as its product may be consumed before cleaning is required, this would be an issue for a reusable dispenser.

Other potential issues are design complexity and component cost. A single-piece molding for an outlet member with a weir is simple and inexpensive, but other constructions are not. Cost is almost always an important consideration with any consumer product, and an ability to simplify a construction would be advantageous.

SUMMARY

A dispenser for a fluid product includes a pump mechanism, a projecting nozzle and an outlet valve at the dispensing end of the projecting nozzle. The outlet valve is constructed and arranged to control the product dispensing in an efficient manner.

While a specific style of pump mechanism and a specific style of projecting nozzle are used for the exemplary embodiment, the principles of the outlet valve are fully applicable whenever a fluid force (fluid pressure) is present at the outlet valve, regardless of how that fluid force is created or generated. It is the fluid force which causes the movement of one outlet valve component relative to another outlet valve component and which opens a flow path for the dispensing of product. These two outlet valve components are snapped together into a cooperating subassembly and are in a normally-closed condition when static or at rest. When a flow of product is presented to the outlet valve subassembly, the fluid force generated by that product essentially creates its own flow opening by causing the movement of one valve component relative to the other. The referenced fluid force could be created by any one of a variety of different pump mechanisms or even the use of a squeeze container. In the exemplary embodiment, this fluid force is created by a pump mechanism. The pump mechanism draws product from within the container and directs that product through the nozzle to the outlet valve and the flow of product is directed into contact with a surface of one outlet valve component which results in the opening of the fluid path through the outlet valve for the dispensing of product.

As disclosed herein, the pump mechanism is the portion of the dispenser responsible for the delivery of the requisite valve opening force. The projecting nozzle conducts the flow of product to the location of the outlet valve. In the exemplary embodiment, the outlet member is a single-piece molded plastic component which includes a first outlet valve component and hinged thereto a second outlet valve component. It is this second outlet valve component which is snapped into the first outlet valve component. This snap-together construction allows the second outlet valve component to be unsnapped, yet still remain hinged, for easy cleaning of the outlet valve.

Some general aspects of the present proposals are set out in the appended claims. Further general options include the following.

The first valve component may comprise a tubular sleeve for fitting into or onto an end opening of the dispenser nozzle. The first valve component may be a generally rigid component. It may comprise a housing defining an internal space which is part of the flow conduit upstream of the closure point or interface location of the valve. The first valve component may provide a mounting for the second valve component to be connected to it, e.g. in one piece, e.g. through a link or hinge part. The first valve component may provide a fixed valve seat against which a mobile portion of the valve comprised in or constituted by the second valve component engages in the closed position, i.e. to form the interface location referred to herein. The fixed seat may be on a projection such as a post comprised in the first component, engaging around or in a corresponding annular outlet opening of the second component to block it.

The second valve component may have an annular wall which fits onto or into an annular wall of the first valve component for the valve to be in an operational condition. The second valve component may comprise a flexible panel defining an outlet opening, e.g. a central opening, bordered or surrounded by a flexing portion. An edge of the opening may constitute a moving part of the valve which, in a closed condition, forms the closing or sealing interface against a fixed seat portion of the first valve component. The closing panel may be flexible at one or more folds thereof, e.g. an annular fold. It may have a rest position in the closed condition of the valve, and be deformed against its own resilience by fluid pressure to open during dispensing.

Further objects, features, aspects, benefits, advantages, and embodiments of the present invention will become apparent from the detailed description and drawings provided herewith.

DESCRIPTION OF THE SELECTED EMBODIMENTS

Figure 1:
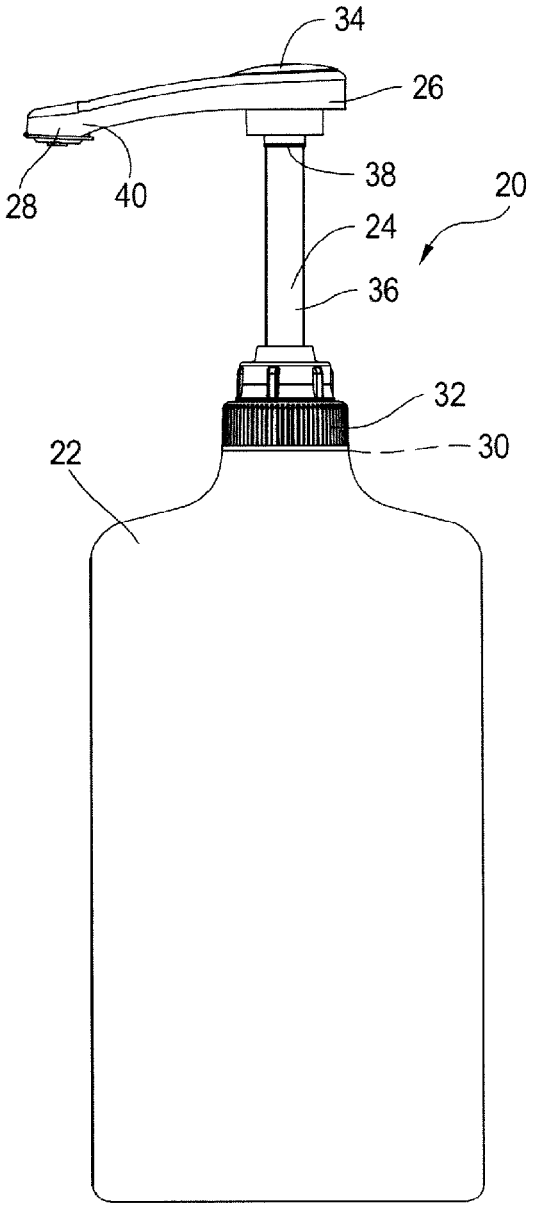
FIG. 1 is a right side elevational view of a pump dispenser incorporating an exemplary embodiment of the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Figure 2:
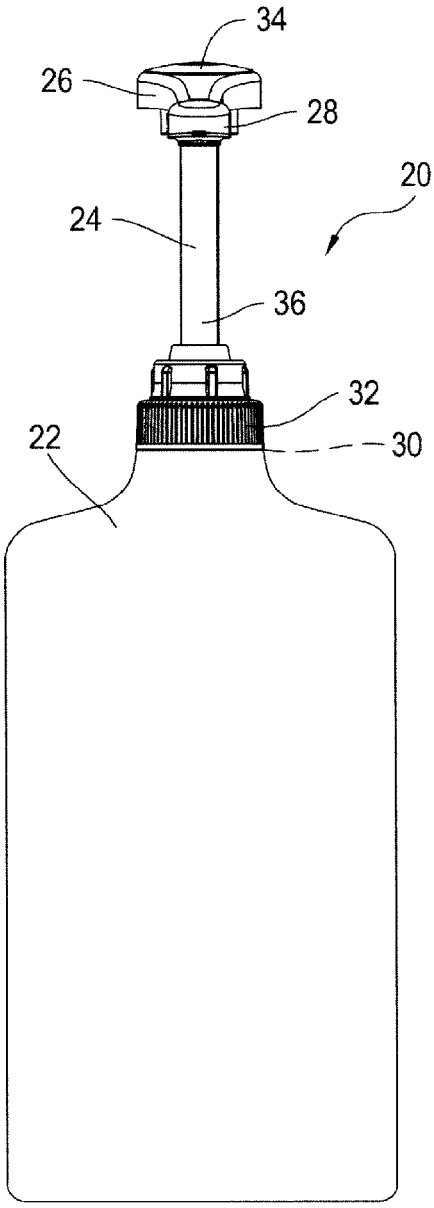
FIG. 2 is a front elevational view of the FIG. 1 pump dispenser.

Referring to FIGS. 1 and 2, there is illustrated a pump dispenser 20 which incorporates an exemplary embodiment of the claimed invention. The pump dispenser 20 includes a container 22, a pump mechanism 24, a nozzle 26 and an outlet valve 28. In the exemplary embodiment, the container 22 includes a threaded neck 30 and the collar 32 of the pump mechanism 24 is threaded and secures the pump mechanism 24 to the container 22, as illustrated. The pump mechanism 24 is operated by depressing the nozzle 26. The actuator end 34 of the nozzle 26 is fitted onto stem 36 which energizes the pump mechanism 24 for the dispensing of a portion of the fluid product which is in the container 22. This dispensing is performed by way of the nozzle 26 and ultimately by way of the outlet valve 28 which is assembled into the dispensing end 40 of the nozzle.

In the exemplary embodiment, the nozzle 26 and the outlet valve 28 are preferably molded out of a suitable grade of polypropylene. This material is also suitable for portions of the pump mechanism 24. The piston of the pump mechanism and the dip tube might preferably be fabricated out of HDPE. An alternative material for the fabrication of the dip tube is LDPE.

Figure 6:
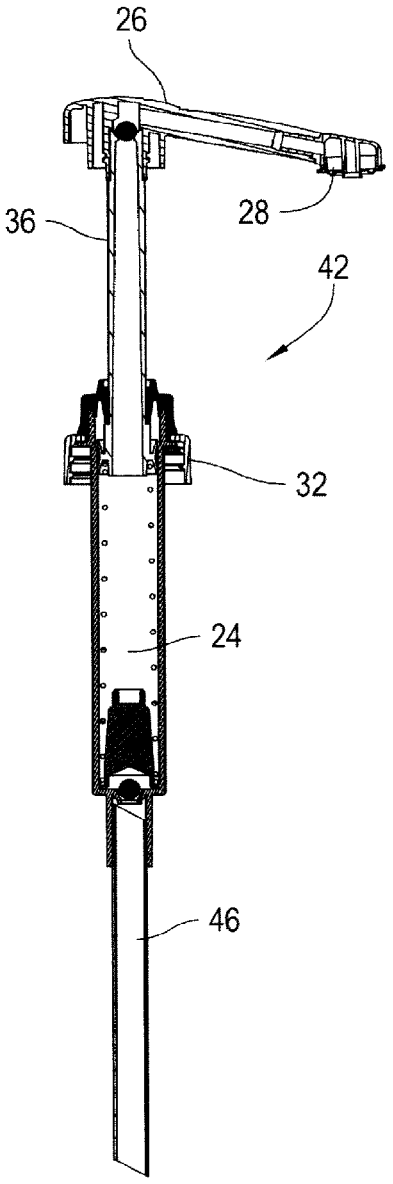
FIG. 6 is a left side elevational view, in full section, of the FIG. 3 pump mechanism and nozzle subassembly.
Figure 7:
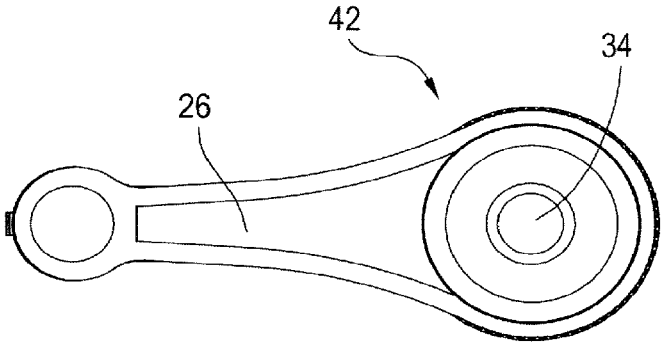
FIG. 7 is a top plan view of the FIG. 3 pump mechanism and nozzle subassembly.

As the various terms are used herein, the "container" is the component which contains the fluid product and is attached to the pump mechanism 24 by the use of the threaded collar 32 as it is threadedly secured to the container neck 30, as disclosed and illustrated for the exemplary embodiment. The "pump mechanism" includes all of the components and structures which are illustrated in FIG. 6, except for the nozzle 26 and outlet valve 28. There is a ribbed, snap-fit of the actuator end 34 of the nozzle 26 onto the upper end 38 of hollow stem 36. The nozzle 26 is the conduit which directs the fluid product being dispensed from the upper end 38 of stem 36 to the outlet valve 28. The "outlet valve" is the hinged, two-part component which has a snap fit into the distal, dispensing end 40 of the nozzle 26.

Figure 3:
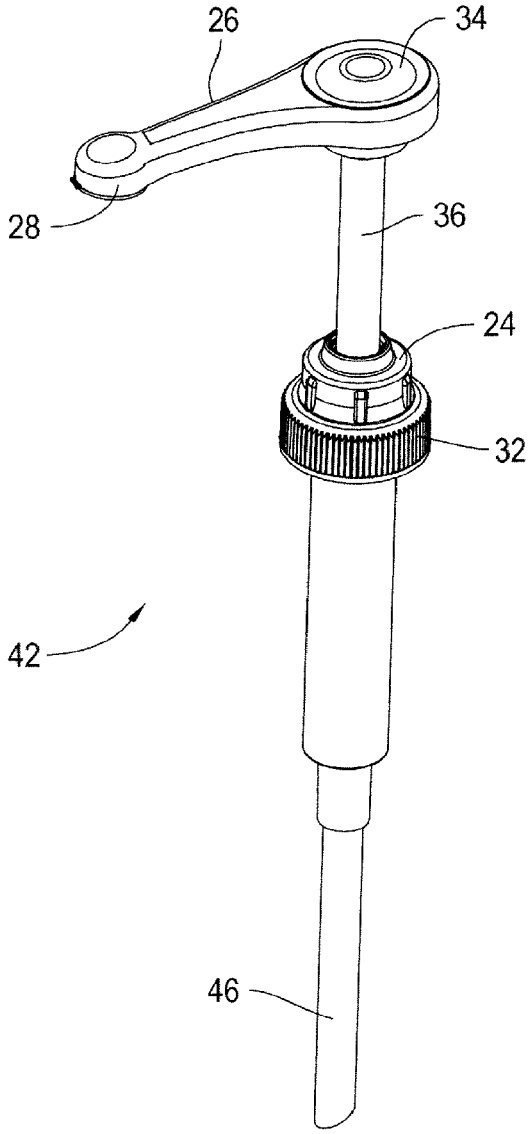
FIG. 3 is a perspective view of the pump mechanism and nozzle subassembly of the FIG. 1 pump dispenser.
Figure 4:
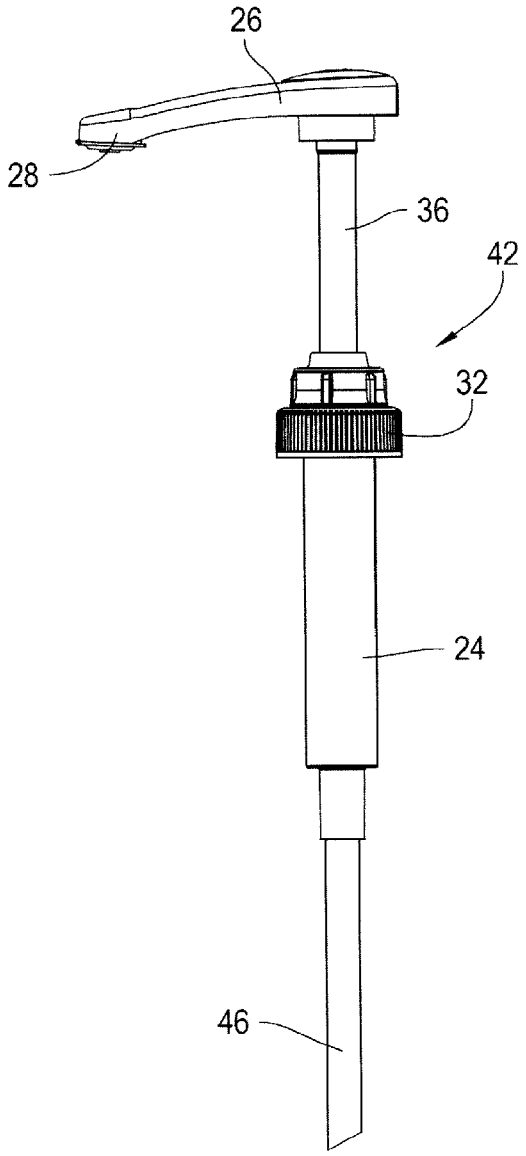
FIG. 4 is a right side elevational view of the FIG. 3 pump mechanism and nozzle subassembly.
Figure 5:
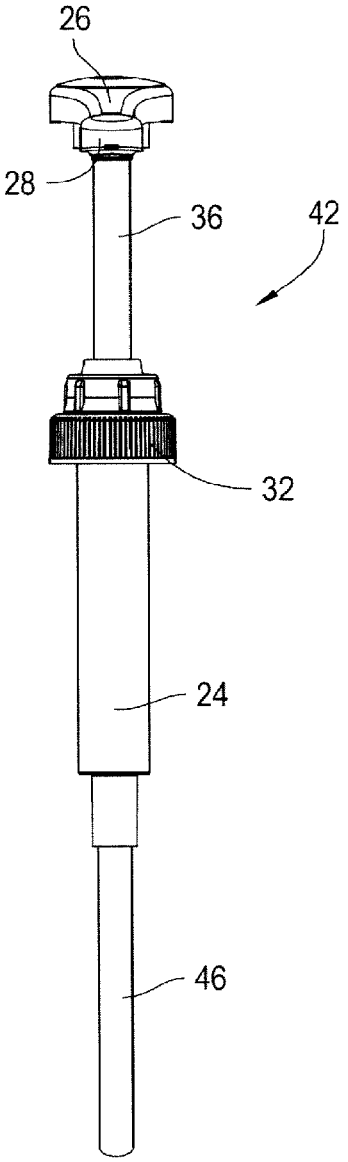
FIG. 5 is a front elevational view of the FIG. 3 pump mechanism and nozzle subassembly.
Figure 8:
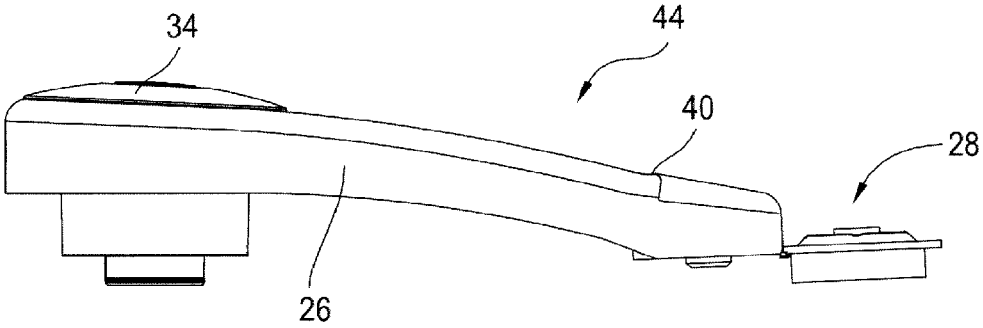
FIG. 8 is a left side elevational view of the nozzle subassembly of the FIG. 3 pump mechanism and nozzle subassembly with a valve component hinged open.
Figure 8A:
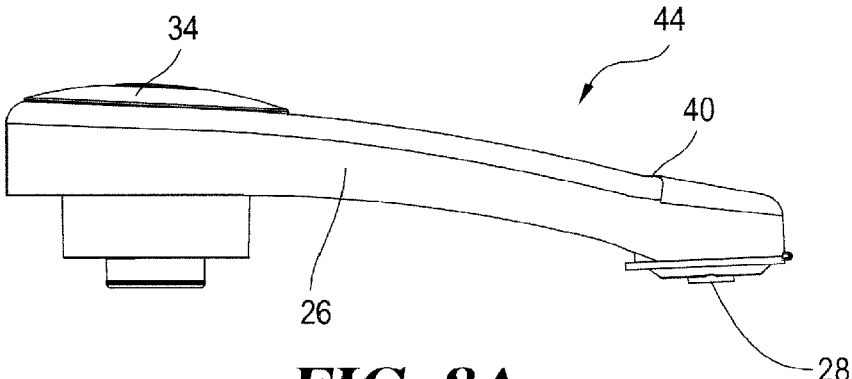
FIG. 8A is a left side elevational view corresponding to FIG. 8 with the valve component closed.
Figure 9:
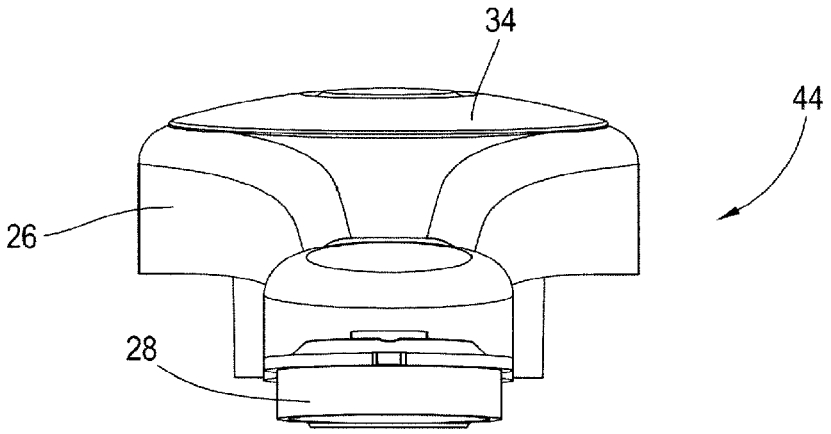
FIG. 9 is a front elevational view of the FIG. 8 nozzle subassembly.
Figure 10:
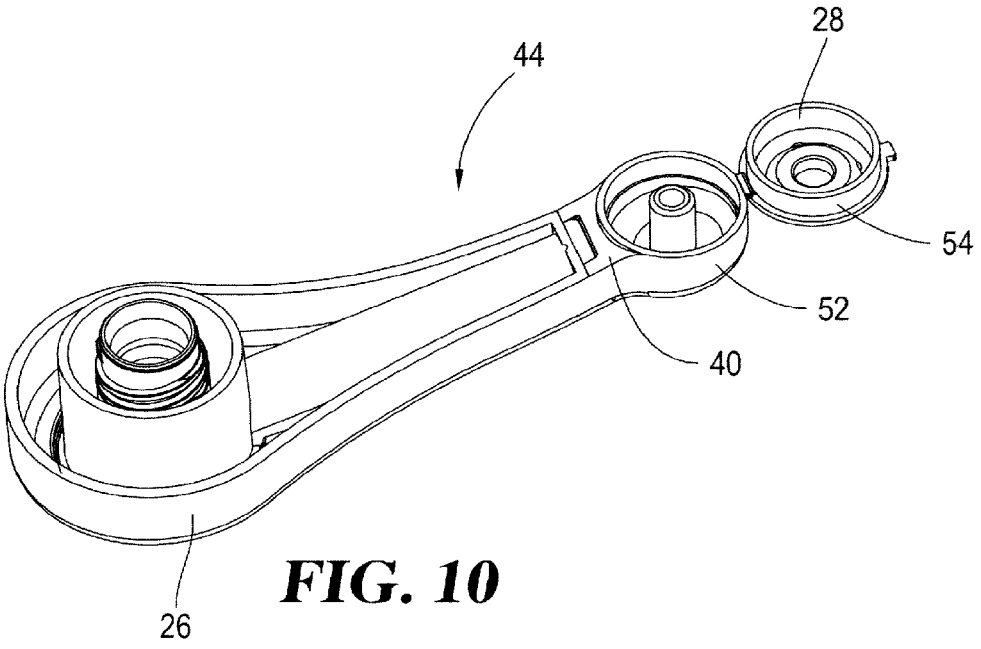
FIG. 10 is a bottom perspective view of the FIG. 8 nozzle subassembly.
Figure 11:
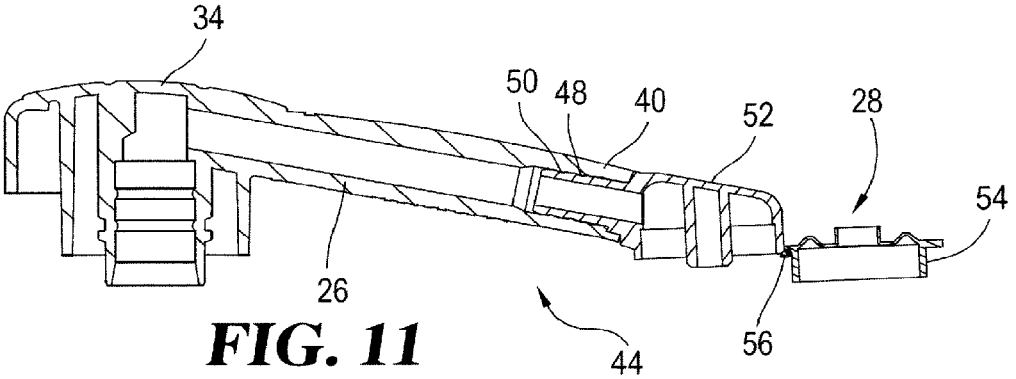
FIG. 11 is a left side elevational view, in full section, of the FIG. 8 nozzle subassembly.
Figure 11A:
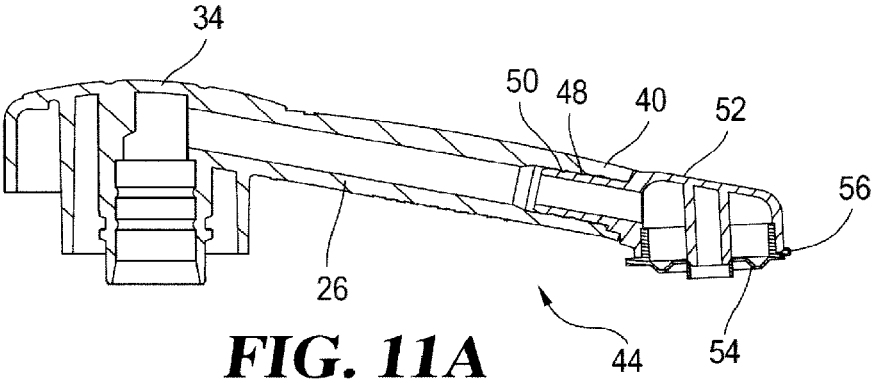
FIG. 11A is a left side elevational view, in full section, of the FIG. 8A nozzle subassembly.
Figure 12:
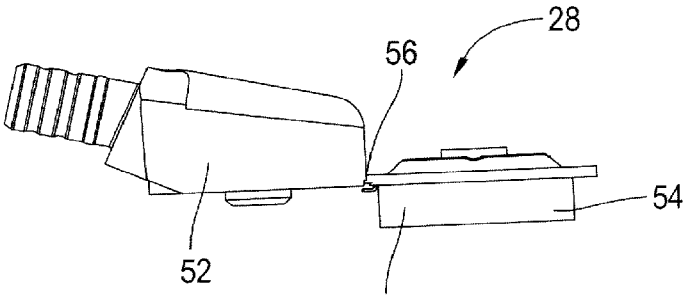
FIG. 12 is a left side elevational view of the outlet valve of the FIG. 8 nozzle subassembly.
Figure 13:
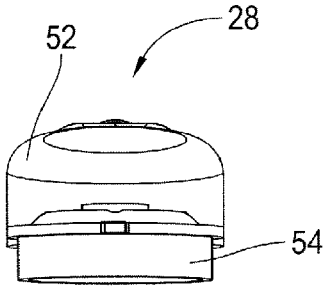
FIG. 13 is a front elevational view of the FIG. 12 outlet valve.
Figure 14:
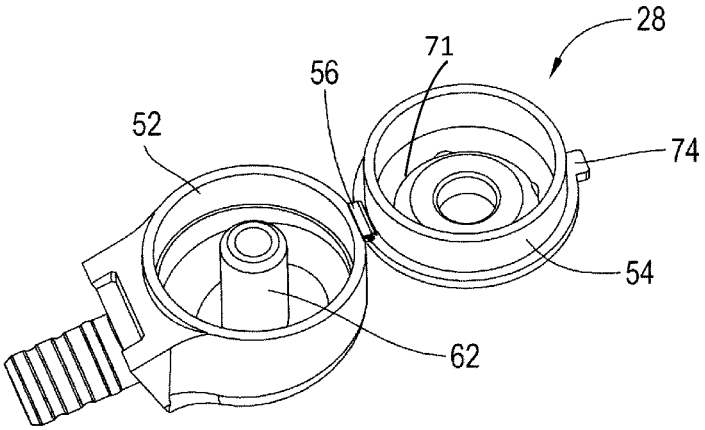
FIG. 14 is a bottom perspective view of the FIG. 12 outlet valve.

In view of the snap-fit assembly of these various component parts, the term "dispenser" could be used to describe everything except the container and product. Similarly, the phrase "nozzle subassembly" could be used to describe the snap-together combination of the nozzle 26 and the outlet valve 28. For the exemplary embodiment, the FIG. 3 assembly is referred to as dispenser 42 and the FIG. 8 assembly is referred to as nozzle subassembly 44.

With continued reference to FIGS. 1 and 2, it will be understood that some volume of product is present within container 22 and the lower end of the dip tube 46 of the dispenser extends into that volume of product. The depression of the actuator end 34 in a downward direction causes the initiation of a dispensing cycle as a portion of the product travels up stem 36 and into nozzle 26. The portion of product which constitutes the dispensing dose travels through the interior passage of the nozzle to the outlet valve 28.

The dispenser 42 which is illustrated in FIGS. 3-7, corresponds to the structural description and functional explanation provided above. The section view of FIG. 6 represents one style of pump mechanism suitable for use with and as a part of the present invention. This section view also shows the entire product flow path from the dip tube 46 to the outlet valve 28. The present invention includes a novel and unobvious outlet valve 28 which functions to manage the dispensing of product which is delivered to the location of the outlet valve 28 by the pump mechanism 24 by way of the nozzle 26. The important aspect is that the arriving product creates a fluid force against a portion of a valve component of the outlet valve 28 which in turn opens a flow path for the product by way of the outlet valve 28. A fluid force applied over a portion of the valve component and the pressure generated as a result is the necessary ingredient for the flexing of the referenced valve component. It is this flexing of the referenced valve component which opens the flow path for the product to exit the outlet valve 28. This aspect of the exemplary embodiment is described in more detail hereinafter.

The disclosed outlet valve 28 provides a novel and unobvious construction for a dispensing nozzle subassembly for a dispenser and for a pump dispenser, as these terms and phrases are used herein. The novel and unobvious construction of the outlet valve 28 is independent of the nozzle 26 construction and independent of the pump mechanism construction so long as a sufficient fluid force is able to be delivered to the outlet valve 28 since it is the fluid force of the arriving product which opens the outlet valve 28 for dispensing of the product.

Referring now to FIGS. 8-11A, the nozzle subassembly 44 is illustrated. As noted, nozzle subassembly 44 includes the nozzle 26 and assembled into the dispensing end 40 of the nozzle, the outlet valve 28. The manner of assembly for the exemplary embodiment is by a snap-fit (see FIG. 11). The nozzle 26 is a single-piece, molded plastic component. The outlet valve 28 is a single-piece, molded plastic component. These molded plastic parts can easily include suitable assembly forms and features such as snap-over ribs, detents, etc. In the exemplary embodiment, annular snap-over ribs 48 and cooperating annular grooves 50 are used for the snap-fit assembly of the outlet valve 28 into the dispensing end 40 of the nozzle 26. While the raised annular ribs 48 are shown on the outlet valve 28 and the grooves 50 shown on the inside surface of dispensing end 40, these snap-fit forms can be reversed and this snap-fit feature can be accomplished by a variety of different mechanical features and forms. The important aspect is to have a secure assembly of the outlet valve 28 into the dispensing end of the nozzle 26 and this secure assembly needs to be established in an efficient and reliable manner so that this interface is leak-free.

Referring to FIGS. 12-15A, the outlet valve 28, as a separate, unassembled component, is illustrated. Outlet valve 28 is constructed and arranged with two valve components 52 and 54 which are hinged together by living hinge 56. This allows the molding of outlet valve 28 as a single-piece, plastic part. Valve component 52 includes annular sleeve 58 and housing 60. Housing 60 includes a generally cylindrical post 62 and an outer annular surface in the appearance of an annular side wall 64. A flow path for product is defined in part by sleeve 58 and extends into the annular space 66 surrounding cylindrical post 62. Sleeve 58 connects to housing 60 at an obtuse angle, and fluid flowing therethrough would be redirected in a similar manner.

Valve component 54 includes an outer annular wall 68 and a closing panel 70 with a sleeved opening 72. Outer annular wall 68 is integrally connected to valve component 52 by living hinge 56. Sleeved opening 72 is constructed and arranged such that post 62 fits against the inner peripheral edge of sleeved opening 72 with a normally-closed fit so as to seal closed that annular interface (see FIG. 15A). One small peripheral section of valve component 54 is hinged to valve component 52 by living hinge 56.

The remainder of the outer annular wall 68 fits securely into and around the outer wall of housing 60 as defined in part by the outer annular surface 64. When valve component 54 is hinged into a closed condition (see FIG. 15A), annular wall 68 fits closely inside of housing 60. This hinged-closed movement positions one valve component 52 relative to the other valve component 54 such that the annular interface between sleeved opening 72 and post 62 is the only potential flow passage for product. As described, this annular interface is normally closed due to the tight fit between the two valve components 52 and 54 at this interface location when the two valve components are closed.

With the two valve components 52 and 54 in their closed condition, when product reaches annular space 66, the fluid force is directed against the inside surface of closing panel 70. A pressure is created due to the fluid force over the area of panel 70 and the flexibility of the plastic used for panel 70 and the construction of panel 70 as part of valve component 54 causes panel 70 to flex or bow outwardly into a generally convex shape, facing outwardly, and with a corresponding concave shape, facing inwardly. Panel 70 may include an annular ridge 71. The concave shape created in panel 70 results in a separation at the annular interface between sleeved opening 72 and post 62. What was a normally closed annular interface now is opened. The opening which is actually separation between panel 70 and post 62 defines a dispensing flow path for the product in annular space 66.

Figure 15:
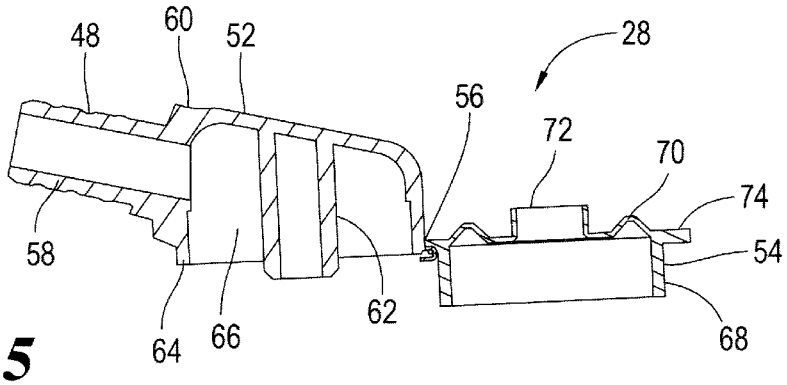
FIG. 15 is a left side elevational view, in full section, of the FIG. 12 outlet valve, with a valve component hinged open.
Figure 15A:
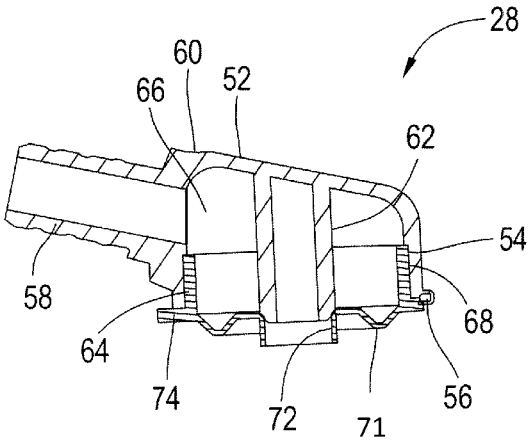
FIG. 15A is a left side elevational view corresponding to FIG. 15 with the valve component closed.

An exposed portion of valve component 54 includes a small finger tab 74 which is accessible to a user to be able to initiate a pivoting movement for valve component 54 to be able to move it from the closed condition of FIG. 15A to the open condition of FIG. 15. The ability to hinge open valve component 54 relative to valve component 52 enables the easy cleaning of the outlet valve 28. The use of a living hinge 56 permits the single-piece fabrication of both valve components 52 and 54 as joined together for creating outlet valve 28. Further, when opening the outlet valve 28 for cleaning, the living hinge 56 tethers the two valve components 52 and 54 together so that valve component 54 cannot be separated, dropped or lost.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

I claim:

1. A washable nozzle subassembly fitted on a dispensing nozzle of a pump dispenser, the washable nozzle comprising:

a tubular sleeve having a proximal end connectable to the dispensing nozzle and, at a distal end, an outlet with a cylindrical post surrounded by an annular space defined by the tubular sleeve;

an outlet valve having a flexible closing panel and an opening, said opening engaging the cylindrical post and cooperating with the flexible closing panel to seal the outlet when at least a portion of the outlet valve is engaged with the outlet;

a hinge connecting the distal end of the tubular sleeve to a peripheral portion of the outlet valve, said hinge allowing the outlet valve to selectively pivot open and away from the outlet; and wherein, when a sufficient fluid pressure is applied within the annular space, the flexible closing panel is displaced and the opening moves away from the cylindrical post to temporarily create a flow path between the tubular sleeve and the outlet valve, the cylindrical post is coaxially positioned within a housing defining the annular space.

2. The washable nozzle subassembly according to claim 1 wherein the hinge is a living hinge.

3. The washable nozzle subassembly according to claim 1 wherein the flexible closing panel, when the at least a portion of the outlet valve is engaged with the outlet, bows outwardly or away from the outlet in a convex shape in response to the sufficient fluid pressure.

4. The washable nozzle subassembly according to claim 1 wherein the flexible closing panel includes a concave shape facing inwardly or toward the outlet.

5. The washable nozzle subassembly according to claim 4 wherein the concave shape results in separation between the cylindrical post and the opening when the sufficient fluid pressure is applied so as to create the flow path.

6. The washable nozzle subassembly according to claim 1 wherein the outlet valve includes a cylindrical wall, said cylindrical wall engaging an inner circumferential facing along the annular space of the tubular sleeve when the hinge is in a closed position.

7. The washable nozzle subassembly according to claim 6 wherein the flexible closing panel is attached to the cylindrical wall at an end that is not received within annular space.

8. The washable nozzle subassembly according to claim 1 wherein the proximal end of the tubular sleeve includes ribs or grooves for engaging the dispensing nozzle.

9. The washable nozzle subassembly according to claim 1 wherein the tubular sleeve is shaped to redirect fluid received from the dispensing nozzle to the outlet at an obtuse angle.

10. The washable nozzle subassembly according to claim 1 wherein the flexible closing panel includes an annular ridge surrounding the opening, said ridge protruding downward and away from the annular space.

11. The washable nozzle subassembly according to claim 1 wherein the cylindrical post extends downward beyond a lowermost edge of a cylindrical sidewall of the housing.

12. The washable nozzle subassembly according to claim 1 wherein the cylindrical post is formed to protrude downward from a top wall of the housing so as to allow fluid to flow completely around the cylindrical post.

13. The washable nozzle subassembly according to claim 1 wherein the outlet valve includes a finger tab disposed along a separate peripheral portion of the outlet valve relative to the hinge.

14. A pump dispenser comprising a pump mechanism, an actuator having a dispensing nozzle, and the washable nozzle subassembly according to claim 1.

15. The pump dispenser according to claim 14 wherein the washable nozzle subassembly is snap-fitted to the dispensing nozzle.

16. The pump dispenser according to claim 14 wherein the washable nozzle subassembly dispenses fluid vertically downward without leakage of fluid from the washable nozzle subassembly when the pump dispenser is not being actuated.

* * * * *